United States Patent [19]

Kahn

[11] Patent Number: 4,688,255

[45] Date of Patent: Aug. 18, 1987

[54] COMPATIBLE AM BROADCAST/DATA TRANSMISISON SYSTEM

[76] Inventor: Leonard R. Kahn, 137 E. 36th St., New York, N.Y. 10016

[21] Appl. No.: 731,770

[22] Filed: May 8, 1985

Related U.S. Application Data

[63] Continuation-in-part of Ser. No. 614,481, May 29, 1984, abandoned.

[51] Int. Cl.[4] ..... H04H 5/00

[52] U.S. Cl. ..... 381/16

[58] Field of Search ..... 381/2, 15, 16, 12; 455/61; 370/11, 76, 122, 123; 332/40, 41; 375/39, 42

[56] References Cited

U.S. PATENT DOCUMENTS

| | | | |
|---|---|---|---|
| 2,666,133 | 1/1954 | Kahn | 250/17 |
| 3,218,393 | 11/1965 | Kahn . | |
| 3,341,833 | 9/1967 | Jones | 340/174.1 |
| 3,908,090 | 9/1975 | Kahn | 325/59.X |
| 3,943,293 | 3/1976 | Bailey | 381/13 |
| 4,194,154 | 3/1980 | Kahn | 455/114 |
| 4,238,849 | 12/1980 | Gassemann | 370/11 |
| 4,373,115 | 2/1983 | Kahn | 332/17 X |
| 4,379,947 | 4/1983 | Warner | 370/11 |
| 4,388,493 | 6/1983 | Maisel | 381/4 |

OTHER PUBLICATIONS

Kahn, "Comparison of Linear Single-Sideband Transmitters with Envelope Elimination and Restoration Single-Sideband Transmitters", Proc. IRE vol. 44, pp. 1706–1712, Dec. 1956.

*Primary Examiner*—Forester W. Isen

[57] ABSTRACT

A system for transmitting a composite signal comprising a data transmission signal component and an AM broadcast signal component. The broadcast signal component may be monophonic or stereophonic. The level of the data signal component is made a function of the modulation level so that the data signal is masked by the program modulation and, therefore, AM radio listeners will not be disturbed by the data signal. The rate of data transmission, in one embodiment, is reduced as the level of the data signal is reduced. The data signal is in quadrature with the AM carrier so as to minimize detection of the data signal by an envelope demodulator. Suitable data receivers are also disclosed.

18 Claims, 4 Drawing Figures

MONO SIGNAL SOURCE
AM MONO GEN
100
IF DOUBLE SB AM WAVE
AM STEREO GEN
102
IF STEREO WAVE
L
R
IF CARRIER
90° ADJ
118
MONITOR 1
104
MONITOR 2
106
L+R
107
108
LEVEL DET
TO DATA SOURCE
FLATTERER OPTION
130
LIM
132
TD
138
FREQ TRANSL
140
RF TO XMTR
148
134
136
TD
AF TO XMTR
15 HZ
144
Ø MOD
146
HFO
142
120
122
124
BPF
126
PSK DEMOD
128
FB NETWORK
MONITOR 3
ATTEN
116
BAL MOD
114
PSK MOD
112
LINEAR
110
FROM DATA SOURCE

COMPATIBLE AM BROADCAST/DATA TRANSMISISON SYSTEM

CROSS REFERENCE TO RELATED APPLICATION

This application is a continuation-in-part of my copending application, Ser. No. 06,614,481 now abandoned, entitled Compatible AM Broadcast/Data Transmission System, filed May 29, 1984.

BACKGROUND OF THE INVENTION

While the invention is subject to a wide range of applications, it is especially suitable for use in a system for transmitting data concurrently with the transmission of music and voice programs using the same transmitting and antenna structure as a conventional amplitude modulation (AM) broadcast station.

There have been a number of methods proposed for transmitting data along with an AM broadcast signal. Most of these methods transmit data at relatively slow speeds. Generally, the data is transmitted by phase or frequency modulating the carrier and then this angular modulated wave is amplitude modulated by the normal music and voice program material. The resulting composite modulated wave can then be demodulated with an envelope demodulator to extract the normal program material. Since the envelope demodulator is insensitive to the phase of the composite wave, listeners are unaware of the data modulation. Indeed, secret transmissions have been reported to have been made with such a system during World War II.

However, the rate of information flow through such systems have generally been very slow. If higher data rates are attempted, the bandwidth of the composite wave will be noticeably wider than normal AM broadcast signals because each sideband generated by the phase or frequency modulation is then surrounded by sidebands produced by the amplitude modulation process.

There are two basic types of interference that are pertinent to the instant invention.

The first is self interference, specifically interference to those wishing to receive the normal broadcast program on the one hand and interference to data reception on the other.

The second type of interference is interference to listeners to other stations, both adjacent or co-channel stations.

Considering first the self interference and, more specifically, interference to the normal broadcast program listeners, it is important that the data signal not be detectable.

The instant invention accomplishes substantially interference-free operation by a number of mechanisms. First of all, and in common with the prior art, the modulation for the data is substantially a form of angular modulation; i.e., quadrature modulation. While quadrature modulation includes an inphase (envelope) component which can be detectable by envelope detectors, the amplitude is small. For example, if each of the quadrature modulation sidebands is restricted, to a say 10% of the carrier amplitude, the resulting envelope modulation is approximately 1%. It must be stressed, however, that errors in receiver tuning, multipath conditions, etc. can convert the quadrature sidebands to larger in-phase components. Fortunately, under most conditions such problems will not cause any difficulty.

In one embodiment of this invention, as shown in FIG. 1 and described below, it is seen that means are provided for controlling the amplitude of the quadrature modulation sidebands as a function of the program amplitude modulation. Thus, when the normal program is absent, the data quadrature modulation sidebands are reduced to zero amplitude. However, as the amplitude modulation increases, the radiated level of the data sidebands is increased so that, for one embodiment of the invention, the quadrature modulation sidebands are always at least approximately 15 db below the level of the program amplitude modulation sidebands. This provides a masking effect for listeners to the normal broadcast program in addition to the isolation provided by quadrature modulation and, for all practical purposes, the data sidebands do not interfere, under normal conditions, with the broadcast channel.

This invention may be used to transmit both monophonic and stereophonic broadcast program material. All proposed methods of transmitting stereo require both in-phase and quadrature modulation components. In the stereo systems, the L-R components produce angular modulation. Thus, the demodulation means for such stereo signals is responsive to angular modulation and would be subject to interference by the data quadrature modulation components. In at least one presently operating AM Stereo system, the ISB system, as described in U.S. Pat. Nos. 3,908,090 and 4,373,115 uses a mixed highs (i.e., where stereo separation is substantially reduced or eliminated above a frequency, say, in the order of 6 to 8 kHz) method of operation is provided. At some frequency, generally 6 to 7 kHz, the stereophonic separation is reduced substantially. Accordingly, the sensitivity of the receiver to frequencies above 6 or 7 kHz to angular modulation can be greatly decreased without altering the stereo performance.

In order to maintain the low interference characteristic for stereo reception of the amplitude modulated signal, the data is transmitted preferably in the frequency range where the "mixed highs" technique is functioning. Accordingly, the data is quadrature sidebands at a frequency of 10 kHz in the United States and 9 kHz in certain other countries.

By the use of the mixed highs approach the amount of interference suffered by data signal receivers is also minimized because the broadcast material has little or no angular modulation at the frequencies to which the data receiver must respond. The data receiver transmission system would best use modulation techniques that can produce low data error counts even when subject to relatively poor signal-to-noise and interference situations. It is also, of course, possible to use various error correcting codes or at least error sensing codes plus redundancy to further decrease data error counts.

The second type of interference; i.e., interference to adjacent channels may be maintained within acceptable levels by always maintaining the data sidebands well below the level of the AM broadcast signal.

A general object of the present invention is to provide a system for transmitting data concurrently with normal broadcast programs over a standard AM broadcast station.

A further object is to achieve such concurrent data modulation without disturbing listeners to the normal broadcast programs.

A still further object is to provide data transmission without causing significant additional interference to other broadcast stations.

An additional object is to permit higher speed data transmission with low error rates.

Another ojbect is to porvide suitable data receivers for use with such a system.

An additional object is to transmit the data at a specific frequency that minimizes interference to adjacent channel stations.

SUMMARY OF THE INVENTION

The present invention combines a data transmission signal with an Amplitude Modulated (AM) carrier signal. The two signals are summated linearly rather than multiplied together so that the overall spectrum is not significantly widened. The data signal comprises two sidebands—an upper and a lower-sideband component whose sum is in quadrature with the carrier. One embodiment of this invention uses a baseband phase shift keying (PSK) signal with a frequency of 10 kHz in the United States and 9 kHz in certain other countries. This frequency is above the frequency range where current Independent Sideband AM Stereo broadcast signals generally limit stereo separation; i.e., 6 kHz in one model, and 7.5 khz in a second model of AM Stereo exciter. The frequency is also well within the normal occupied bandwidth of AM broadcast signals. A spectrum drawing of such a signal is shown in FIG. 3.

Since the data signal is in quadrature with the carrier and the L+Ror envelope modulation component of the broadcast stereo signal occupying the same spectrum space, the system makes good use of the station's authorized bandwidth.

In addition to quadrature relation of the data signal minimizing interference, the invention takes advantage of the "masking" phenomenon. This is a phenomenon whereby, under certain conditions, listener's threshold of hearing to one sound is raised by the presence of a second sound. Details concerning "masking" are treated by Fletcher in "Speech and Hearing in Communications", D. Van Nostrand, 1953.

In order to make effective use of masking, the level of the data signal is maintained below that of the sidebands representing the broadcast program signal. Thus, the data signal is made a function of the broadcast program level.

The rate of data transmission may also be reduced as the data signal level is reduced.

Another feature of the invention improves reception of the data signal. When the data speed is reduced; i.e., when the broadcast modulation level is low, the data modulation is reduced. This reduced data signal level will accordingly reduce the signal-to-noise ratio of the received data signal. The bandwidth of the data receiver channel need not be as wide as during periods of high data flow. Therefore, it is possible and desirable to reduce the data channel bandwidth as a function of the data signal transmitted level. This variable bandwidth filtering means may be used either at IF or at baseband. In other words, BPF 420 in FIG. 4 can be reduced in bandwidth during low speed data transmission periods so as to improve the signal-to-noise ratio and reduce the error count. Alternatively, the lowpass filter, which would normally be part of the PSK demodulation 422, can be made to vary its cutoff as a function of the data rate. An effective method for controlling the bandwidth is to derive a control voltage from the received program audio level. This feature is further described below.

There are a number of means for producing dc controlled bandwidth filters. Recently, an excellent technique called switch capacitor filters has been developed which allows variable bandwidth filters to be implemented with integrated circuits. A variable frequency clock is used to change the cutoff frequencies of such filters. For example, the National Semiconductor Corporation of Santa Clara, Calif., introduced the MF10 universal dual switch capacitor filter. Generall, such filters are used at audio frequencies and can be configured as bandpass or lowpass filters. Thus, those skilled in the art have a number of variable bandwidth filter means, including RF and IF filter means, from which they may choose a filter which best serves their specific design requirements.

The frequency of the subcarrier is preferably equal to the spacing between the main carrier and the closest assigned adjacent channel carrier. In the United States, Canada, and Mexico, for example, this would place the subcarrier at a frequency of 10 kHz, whereas in Europe and Asia, for example, the subcarrier frequency would be 9 kHz.

There are a number of reasons why the subcarrier frequency should be thus selected.

First of all, by causing the subcarrier to fall at the adjacent carrier frequency the beat will not cause an audible whistle. conversely, if, say 8.5 kHz was used in countries where 10 kHz carrier channel spacing was allocated, a 1.5 kHz heterodyne whistle would be heard, causing severe listening problems.

Furthermore, because 10 kHz whistles caused by heterodynes between adjacent channel carriers are prevalent at night in the United States, it is common practice to incorporate 10 kHz notch filters in wideband AM receivers. Narrow band receivers do not incorporate such notch filters because their RF, IF and audio frequency responses combine to provide substantial rejection for the 10 kHz whistels. Therefore, since conventional receivers incorporate protection against 10 kHz whistles, this protection can be used to reduce interference from the new 10 kHz data subcarrier.

Conversely, if, say a 8.5 kHz subcarrier was used, the receiver's 10 kHz whistle filters would be ineffective and the other filtering incorporated in conventional receivers would provide substantially less protection.

Choice of a subcarrier frequency that causes the adjacent channel carrier to fall right into the center of the data channel might be expected to provide very poor data performance. However, such a choice of subcarrier frequencies has certain unique and unexpected advantages providing a situation conceptionally analogous to flying into the eye of a storm. For example, if a frequency discriminator is used to detect phase shift keying, the fact that the interference falls very close to the PSK signal's carrier actually substantially reduces the interference output from the frequency discriminator.

Accordingly, use of a subcarrier frequency equal to the main carrier spacings will, for certain forms of data systems, greatly reduce the effect of interference to the data signal. Thus, there is another significant advantage for making the subcarrier frequency equal to the assigned carrier frequency spacing.

Adjustments can be provided for the subcarrier frequency determining oscillators to insure that the heterodyne beat is very low, say within $\times 20$ Hz.

The subcarrier signal may be used to transmit auxiliary information such as information regarding the audio processing used for the main channel's program material. This auxiliary information may be in analog or digital form.

However, it is expected that most applications of this invention will be for the transmission of digital data unrelated to the program signal, for example, stock market, weather forecasts, produce prices, etc. information transmission.

The preferred form of keying for this second modulated wave would be Phase Shift Keying or Differential PSK.

It is also possible to transmit the auxiliary data on just one side of the main (program) modulated wave; i.e., in the United States at a frequency either plus 10 kHz or minus 10 kHz from the main modulated wave's carrier frequency. This can be accomplished, for example, by inserting a bandpass filter between blocks 116 and 104 of FIG. 1 tuned to one of the output frequencies of balanced mixer 114.

While one sideband auxiliary information transmission reduces adjacent channel interference on one side of the main channel, the interference to listeners to the main channel carrying the program modulation is increased because the envelope modulation caused by the auxiliary information carrier is raised. Accordingly, some users will find single-sided auxiliary transmission unacceptable.

If single-sideband transmission is utilized, a single-sideband receiver may be used or a relatively narrow band receiver tuned to the carrier frequency of the auxiliary channel may be used. If an Independent Sideband type AM Stereo receiver, as disclosed in U.S. Pat. No. 4,018,994; for example, is used, the phase shift networks should be extended to cover 10 kHz plus the extra bandwidth to pass the keying sidebands. The auxiliary information demodulator is connected to the appropriate stereo receiver's output port.

For a better understanding of the present invention, together with other and further objects thereof, reference is made to the following description, taken in conjunction with the accompanying drawings, and its scope will be pointed out in the appened claims.

BRIEF DESCRIPTION OF THE DRAWINGS

The foregoing and other objective features and characteristics of the present invention will be apparent from the following specification, description, and accompanying drawings relating to typical embodiments thereof.

DESCRIPTION OF THE PREFERRED EMBODIMENTS

Figure 1:
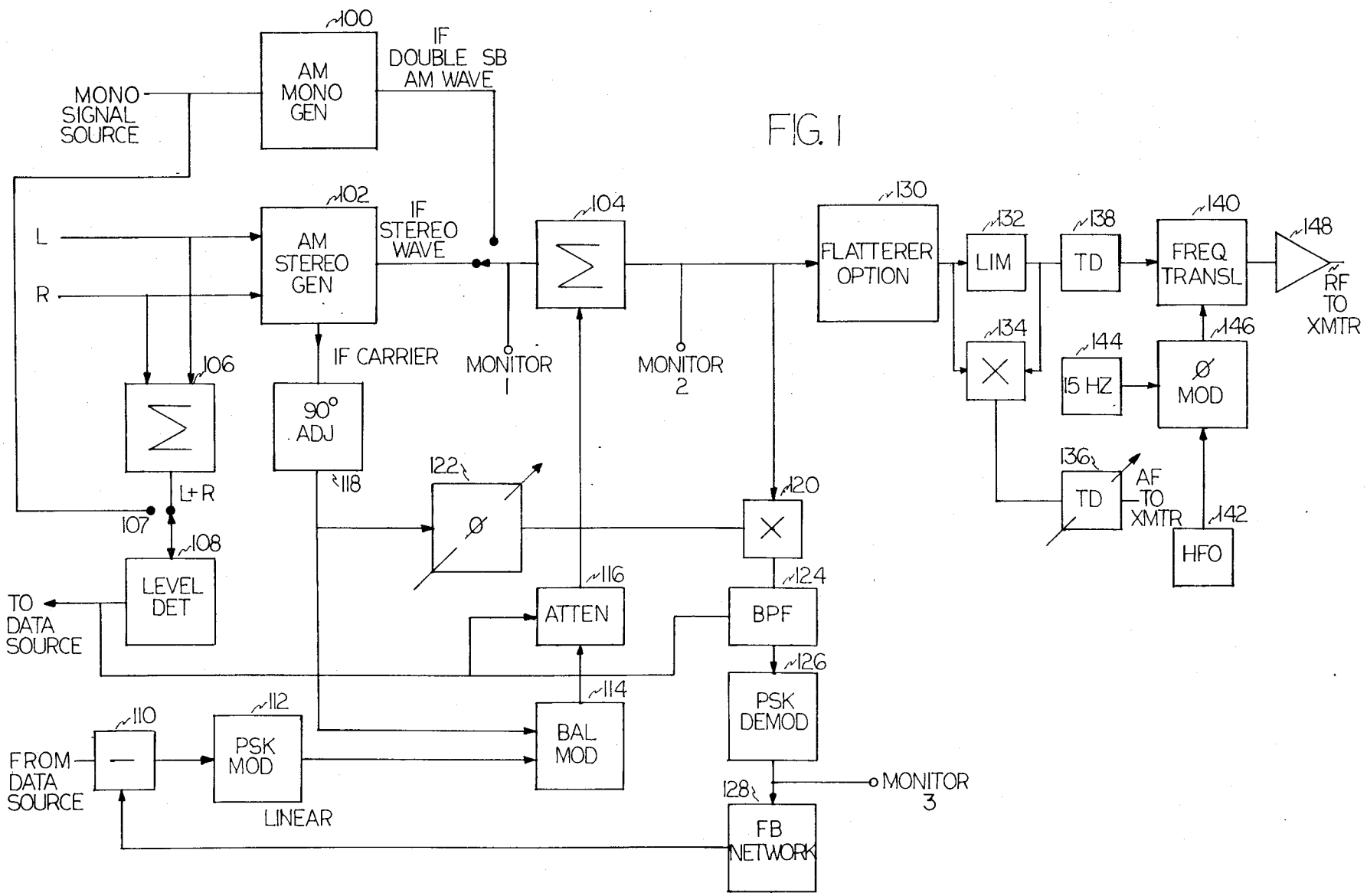
FIG. 1 is a block diagram of one form of transmitter using the invention. This embodiment illustrates the use of phase shift keying but it will be understood by those skilled in the art that other forms of data transmissison might be used, such as, FSK, as well as other engineering design choices.

FIG. 1 is a block drawing showing one embodiement of the subject invention. Block 102 is a source of stereophonic signal such as the circuitry shown in U.S. Pat. Nos. 3,218,393 or 3,908,090 or 4,373,115. It includes an envelope modulator so that the IF wave out of block 102 is a complete stereophonic signal including the L+R component. The preferred form of AM Stereo wave is the independent sideband wave, although the system disclosed herein may be adapted to other forms of AM Stereo such as forms of quadrature modulation proposed by the Harris and Motorola Corporation or the AM/PM system as proposed by Magnavox. The IF stereo wave, which in one embodiment is a 1.4 MHz carrier wave, is fed to summation circuit 104.

The invention may also be used to transmit a data signal with a monophonic signal. For monophonic transmission operation L may be made equal to R, the input signals to the AM stereo generator 102. However, if the station continuously transmits a monophonic signal, block 102 may be deleted and a simple amplitude modulation wave generator 100 be substituted. In this case, switch 103 is thrown to the position connecting AM generator 100. In the following discussion stereophonic transmission is considered, although it will be understood by those skilled in the art that monophonic transmission can be similarly used.

The L and R audio inputs to the stereo generator are also fed to a summation circuit 106 which produces and L+R output. This output is fed to level detector 108. In the monophonic case when block 100 is used, switch 107 is thrown so that the mono signal source feeds level detector 108. The combination of blocks 106 and 108 are used to generate a control that varies the amount of data signal combined with the stereo wave transmitted. This amount must be carefully controlled so that listeners to normal broadcast programs are not disturbed by the data signal. Therefore, it is important that when there are pauses or weak L+R modulation segments the level of the data signal be suitably attenuated so as to avoid interfering with broadcast listeners.

The control signal from level detector 108 controls attenuator 116 which controls the level of the data signal which is combined with the stereo wave in block 104. The level detected control signal is also fed to the data source so as to cause the flow of data to be controlled as a function of the power in the transmitted data signal. At one extreme, when the amplitude of the data signal is maximum because the L+R level exceeds a certain amplitude, the data rate can be maximum. At the other extreme when the L+R is absent or below a certain level so that no data signal can be transmitted, then the data stream must be stopped.

The output of the data source is fed to difference circuit 110, which in turn feeds phase shift keying modulator 112. In order to provide the best feedback effect, the modulator must be a linear phase modulator. A phase locked loop can be used as a phase modulator, for example, the output of block 112 typically would be a 10 kHz and could be phase shift keyed in any one of a number of PSK methods well known to communication system designers. For example, a four phase signal using differential phase detector may be used.

The output of modulator 112 feeds balanced modulator 114 which is also fed an IF carrier component at a phase that will insure the double sideband components that are produced in balanced modulator 114 will be in quadrature with the IF carrier component of the stereo wave fed to summation circuit 104. It is desirable to cause the data sideband components to be in quadrature with the carrier so as to ensure minimum interference to listeners to the AM broadcast program. Block 118 can be adjusted to provide this quadrature relationship.

The double-sideband suppressed carrier wave outputs, which for the example discussed above, are at frequencies of the IF ±10 kHz, are fed to attenuator 116. Attenuator 116 adjusts the level of the PSK data sidebands so that they support the data transmission without interfering with normal broadcast reception. The output of attenuator 116 is fed to summation circuit 104.

If a one sided auxiliary channel is desired, a bandpass filter, tuned to either one of the sidebands of the double sideband suppressed carrier wave, should be connected in the line between blocks 116 and 104 of FIG. 1. As pointed out above, use of a single sideband auxiliary transmission increases envelope modulation due to the data signal and increases self interference to the program channel's listeners. The Flatterer Option block 130, described below, of FIG. 1 may also be deleted for single sided data transmission.

The output of the summation circuit 104 is the complete AM Stereo plus data wave, which must then be converted to the proper carrier frequency and amplitude so as to be suitable to be used with an external transmitter in order to produce the desired combined stereo and data waves at a suitable power level.

A sample of this signal is fed to a circuit for demodulating the data wave so as to provide negative feedback for minimizing errors in the data message. This sample is fed to a product demodulator which is also fed a quadrature carrier component which can be accurately adjusted in phase by variable phase shift block 122. The resulting audio is fed to a BPF 124 that selects the audio PSK wave which in this example is centered at 10 kHz. This filtered PSK is then fed to PSK demodulator 126.

The PSK demodulator 126 should be of the same type as used in a typical data signal receiver. It will be apparent to those skilled in the art that FSK operation will require a FSK demodulator to be used in block 126. Examples of phase shift keying demodulators (as well as FSK demodulators) including differential phase detectors (as well as phase shift modulators) are treated in "Data Transmission", W. R. Bennett and J. R. Davey, McGraw-Hill 1965 and elsewhere.

The output of the PSK demodulator 126 is fed through a feedback network so as to maintain stability and finally to difference circuit 110 to complete the negative feedback path. The negative feedback is helpful in maintaining low error counts even though a certain amount of interference can be expected from stereo components falling within the data channel bandwidth.

However, it must be stressed that a frequency shift keying system will create significantly more interference to adjacent channel stations because only the mark or the space frequency can be made to fall at the carrier frequencies of the adjacent channel stations. For this reason, the phase shift keying system is the preferred system.

The combined stereo and data IF wave is then fed to the "Flatterer" option circuit 130 for minimizing asymmetry in transmitter antennas. Such a circuit was originally disclosed in U.S. Pat. No. 4,194,154. This circuit should be used at stations where the transmitting antenna can be expected to significantly disturb the quadrature between the data channel sidebands and the carrier. If the data sidebands are shifted from their quadrature relationship with the transmitted carrier the data signal can be expected to cause somewhat more interference and be heard by listeners to the main broadcast signal. This problem should not be of concern to stations with wideband symmetrical frequency response antenna system and therefore block 130 is shown dotted and is to be considered optional. For further details of the antenna compensation circuit and its operation, please consult U.S. Pat. No. 4,194,154 the body of which incorporated herein by reference.

The output of the antenna compensation circuit feeds limiter 132 and product demodulator 134 which prepares the wave for use in an Envelope Elimination and Restortion, EER, system as disclosed in U.S. Pat. No. 2,666,133 and a number of publications; including, Kahn "Comparison of Linear Single-Sideband Transmitters with Envelope Elimination and Restortion Single-Sideband transmitter." Proc. IRE, Volume 44, p-p 1706–1712; Dec. 1956. The body of U. S. Pat. No. 2,666,133 is incorporated herein by reference.

Limiter 132 serves the purpose of removing envelope modulation so as to isolate the angular modulation. The input and output of limiter 132 are multiplied together so as to envelope demodulate the output of flatterer 130. The resulting audio wave is fed to adjustable time delay 136 which in turn feeds audio to the audio input of an associated amplitude modulation transmitter.

The angular modulated wave from the limiter 132 feeds time delay circuit 138 which in turn feeds frequency translator 140. The frequency translator is also fed by a final carrier frequency wave generated in oscillator 142. The output of oscillator 142 is phase modulated in modulator 146 by the stereo pilot wave which in the preferred example is 15 Hz wave generated in oscillator 144.

The RF output from frequency translator 140 is amplified in amplifier 148 to a suitable level to excite the associated transmitter, where a high powered combined stereo and data signal is produced.

Figure 2:
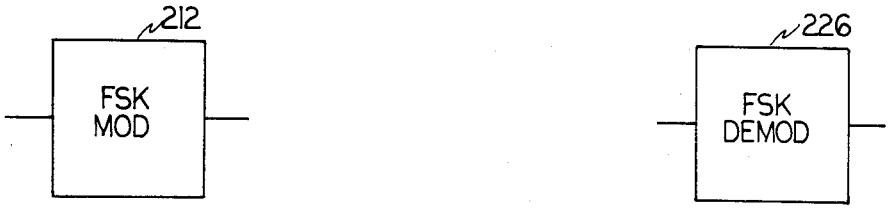
FIG. 2 shows the two blocks that must be substituted in FIG. 1 when frequency shift keying is used for the data transmission rather than phase shift keying system provided for in FIG. 1.
Figure 3:
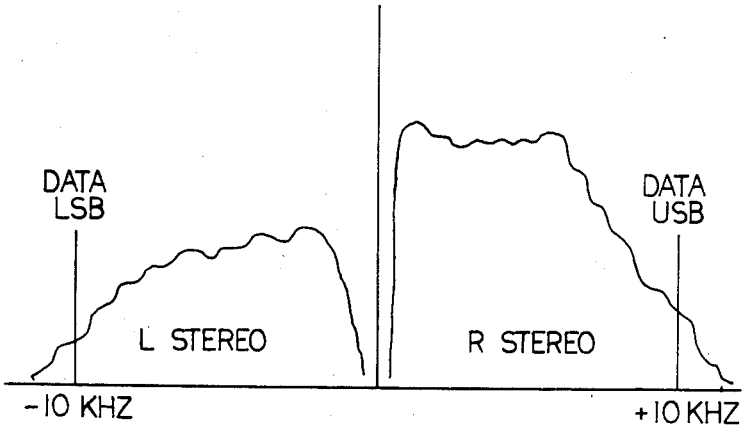
FIG. 3 is a sketch of a typical spectrum signature for the wave produced by a transmission system shown in FIG. 1.

FIG. 2 shows how to modify the phase shift keying data transmission system of FIG. 1 for use with frequency shift keying (FSK) data transmission.

An FSK modulator 212 is substituted for the PSK modulator of FIG. 1. This produces a frequency shift keyed wave which in turn is fed to balanced modulator 114. The frequency shift keyed wave produced should be a true FSK wave, not a two tone wave so that when the circuit is part of the feedback system the corrections for keying distortion by interference from the program broadcast material can be compensated.

Similarly, block 226, in FIG. 2, is substituted for PSK demodulator 126. A phase locked loop circuit can be used for such frequency demodulation. The subject of frequency shift keying is well known and many standard communications provide full information describing such circuitry.

A suitable frequency shift would be 1,000 Hz and the mark frequency could be, for example, 10,000 Hz and the space frequency 9,000 Hz for the transmission of data at a rate up to 1,200 bits/second. In some respects frequency shift keying is more rugged than phase shift keying. However, under favorable conditions phase shift keying has a lower error count.

As mentioned above, in view of interference considerations the PSK systems are preferred.

It is noteworthy that the overall system is most compatible with a frequency separation type stereo such as the Independent Sideband AM Stereo system. Some phase separation systems, such as the system proposed by Motorola, which have relatively poor spectral characteristics can cause splatter into the data channel, increasing error count. Furthermore, having L or R-only program segments will cause the receiver carrier to shift in phase causing data errors. Nevertheless, embodiments of the present invention can be used with phase separation AM Stereo systems and the claims are not limited to frequency separation AM Stereo systems.

The output level of attenuator 116 should be set so that when the data signal is combined with the broadcast signals, the peak phase modulation of the resulting wave caused by the data signal is approximately $\pm 10°$ which will limit peak distortion of the broadcast signal to approximately 5%. Since these figures are peak, the average distortion is to be expected to be significantly less. Also, it is noteworthy, that the distortion drops rapidly with the program percentage of modulation. Indeed, a drop from 100% modulation to 90% reduces the peak distortion to approximately 2.5%.

The use of a high frequency for the auxiliary information signal also will tend to eliminate this distortion. For example, if the subcarrier is 10 kHz and the IF response of the receiver substantially attenuates the 10 kHz sidebands, the distortion due to the auxiliary information signal is, for all practical purposes, eliminated.

This distortion could also, of course, be eliminated completely if the data signal was combined with the broadcast signal in a conventional multiplication process rather than the linear summation process. The penalty would be a significant widening in spectrum occupancy of the combined signal.

Phase shift keying systems generally have a lower error count than FSK. However, PSK can be disturbed by phase modulation of the carrier caused by stereophonic modulation of the main channel. Also, any carrier phase error caused by the data signal can be disturbing to the phase separation stereo systems, such as the Motorola system, that rely on the phase relationship between the carrier and sideband components to transmit the L-R stereo.

Fortunately, the problem is much less significant in the ISB AM stereo system because stereo separation is not a function of the relative phase of the carrier and sidebands.

In FIG. 1, the BPF 124 in the data feedback path is made to vary by using the control voltage from block 108 to vary the bandwidth of filter 124. This is the same type of arrangement as will be used in the receiver shown in FIG. 4.

A very important feature of the certain embodiments of invention is that the transmission speed of the data signal adapts to the level of the normal broadcast signal's program level.

This feature allows relatively high average levels of data flow to be achieved while maintaining low levels of perceived interference. To implement this feature, the flow of data is controlled as a function of the broadcast program level. Those skilled in the data transmission and handling arts will be aware of means for storing data at one rate and recalling it at a variable rate. For example, an endless loop which records the data at one speed, stores the recorded tape, and then takes tape out of storage and playbacks the tape at a variable rate as a function of the level of the broadcast signal may be used. In U. S. Pat. No. 3,341,833, Mr. Paul R. Jones discloses means that may readily be adapted to store and recall data for use in this invention. This body of this patent is incorporated herein by reference. One skilled in the art of designing equipment using semiconductor storage circuits will be able to readily implement the storage and recall means without recourse to tape mechanisms. A clock signal can be recorded along with the data signal and its frequency will then vary directly with the playback tape speed in synchronism with the data flow.

Accordingly, the clock signal can be used to synchronize the received data signal.

Another means for achieving synchronization of the data receiver with the data transmitter is to use a return to zero (RTZ) polar binary signal.

This type of data signal contains symbol timing information. As pointed out in the above referenced Bennett and Davey book, such signals are self-clocking. Each information bearing keying element is surrounded by a zero signal, therefore, the data signal can be fully recovered without providing additional clock information.

As the main program level drops, the speed of data flow is reduced and when the main broadcast signal's modulation is very low or absent, the data flow actually stops. At this time the amplitude of the radiated RF data signal is caused to drop to a very low amplitude or zero. In one arrangement, the full character being transmitted is transmitted prior to any pauses due to low modulation levels. In order to accomplish this, a minimum data speed must be used; for example, say 200 bits/sec. If 8 bits words are used the maximum data tail would be 40 ms, which is a reasonable data tail length, to be masked by the decay waves of speech and music.

If the program modulation is a series of short bursts like some forms of speech waves, the requirement to transmit complete full words may be a problem and significantly reduce speed of transmission.

In some service it may be better to maintain fixed and higher speed data transmission rates; for example, 1,000 bits/sec thus reducing the maximum data tail to 8 ms. This would also eliminate the problem of providing variable bandwidth filters in transmitter and, most importantly, in the receivers where equipment cost may be very important.

Figure 4:
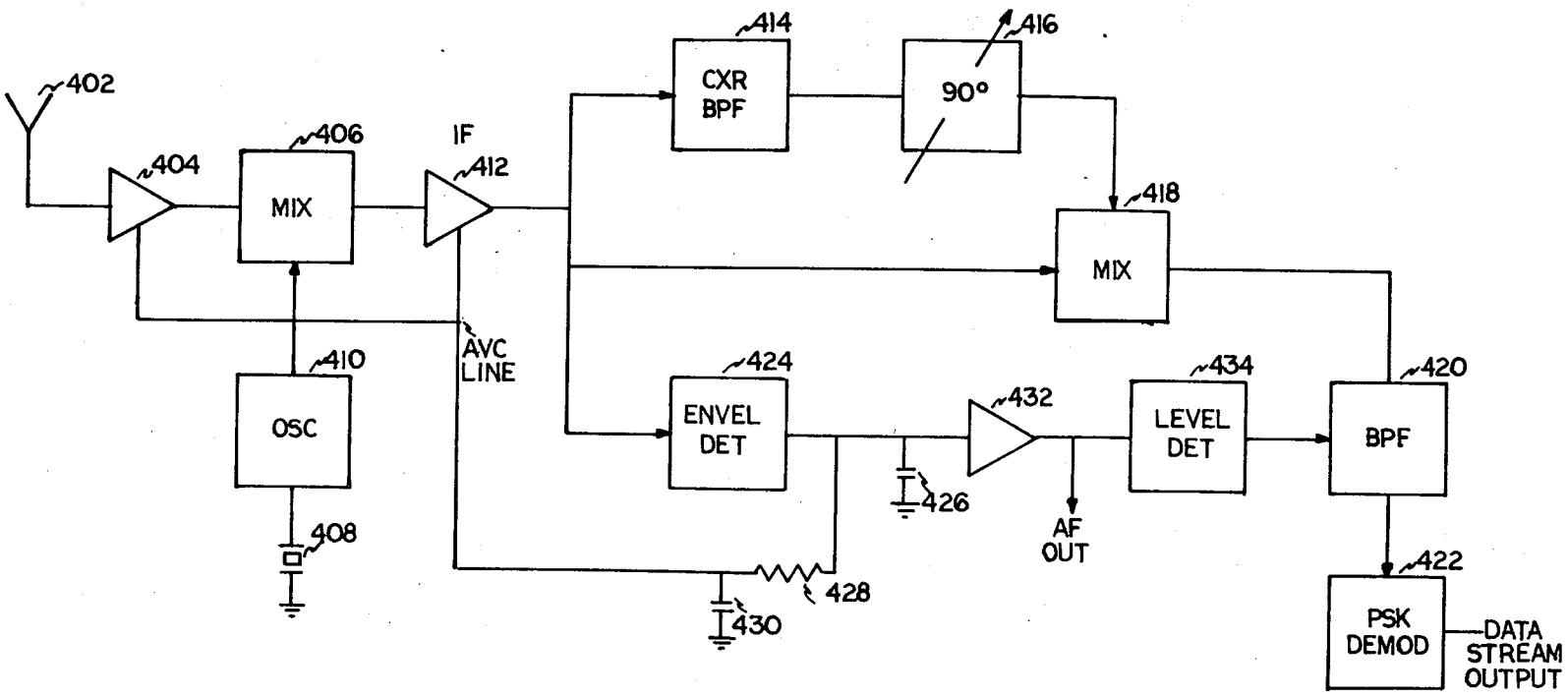
FIG. 4 is a block diagram of a receiver suitable for receiving the signal produced by the transmitter shown in FIG. 1.

FIG. 4 is a block diagram of a receiver suitable for recovering phase shift keying data signals of the type generated by the apparatus of FIG. 1. An antenna, 402, which may be a small ferrite rod antenna feeds an RF amplifier, 404, operating at the carrier frequency of the station to be used. This amplifier, in turn, feeds a mixer 406. A crystal oscillator comprising the oscillator and a quartz crystal 408 provides the proper injection frequency for mixer 406.

The resulting stable IF wave is fed to amplifier 412. The output of this amplifier feeds a carrier bandpass filter which may be a narrow band crystal filter, for example, or it may be a phase locked loop operating as a narrow band filter.

The effective bandwidth of the filter should be quite small so as to remove sideband components and attenuate the pilot modulation which, for one system of stereo broadcasting, is 15 Hz. The output of the filter, 414, feeds a phase shifter which shifts the carrier phase by 90 degrees.

The output of the phase shifter, 416, feeds a mixer circuit 418 which may be a balanced mixer. Also feeding the mixer is a sample of the IF output wave from block 412. The data signal at the output of mixer 418 is selected by bandpass filter 420 whose bandwidth is adjustable and should be wide enough to pass at least first order sideband signaling components. The output of the bandpass filter feeds phase shift keying demodulator 422. Of course, a similar receiver could be used for FSK reception and a suitable demodulator would be substituted for block 422.

Another sample of the IF output of amplifier 412 feeds envelope demodulator 424, the dc component from the envelope detector filtered by capacitor 426, resistor 428 of capacitor 430 produces a suitable AVC voltage for controlling the gains of the RF stage 404 and the IF stage 412. The audio output of envelope 424 is amplified in amplifier 432 which can feed an audio output line if it is desired to utilize the program signal to listen to voice or music transmissions. The output audio wave is rectified or detected by a level detector 434.

This level detector provides control voltage to control the bandwidth of bandpass filter 420. When the level is low the data rate is reduced at the transmitter end and therefore, the bandwidth of the filter can be reduced, improving the signal-to-noise ratio.

Conversely, at higher modulation levels when the data rate is maximized, the bandpass filter 420 must have a wide bandwidth so as to pass the keying information. At this time, of course, the transmitted data level is increased providing sufficient signal level to support the higher speed data transmission.

Those skilled in the receiver art will recognize that it is also practicle to make a data receiver according to this invention that does not use an intermediate frequency but to do the required amplification and filtering prior to demodulation of the data wave at the radio frequency transmitted. Thus, receiver types that are not of the superheterodyne type may be used.

While there have been described what are believed to be the preferred embodiments of the invention, those skilled in the art will recognize that other and further modifications may be made thereto without departing from the spirit of the invention, and it is intended to claim all such changes and modifications as fall within the true scope of the invention.

What is claimed is:

1. A transmission system for transmitting amplitude modulated waves, suitable for reception by conventional amplitude modulation broadcast receivers, simultaneously with the transmission of data signals, comprising:

(a) means for generating an amplitude modulated wave fed by a source of program material and a carrier wave source, (b) data modulation means fed by a source of data said data modulator producing a wave in the audio range, (c) a quadrature modulator fed by the source of carrier waves and by the data modulation means to produce a pair of quadrature modulation sidebands above and below the carrier frequency, (d) means for linearly combining the waves produced by (a) and (c) means, and (e) means, for increasing the power of the combined waves produced by (d) means without introducing significant additional spectrum products.

2. The transmission system of claim 1 wherein the (a) means is a stereophonic generator fed by a stereo source of program material.

3. The transmission system of claim 1 wherein the (a) means is a monophonic generator fed by a mono source of program material.

4. The transmission system of claim 1 wherein subsequent to the (d) combining means the amplitude-frequency and phase-frequency characteristics of the combined wave is altered by network means so as to compensate for the amplitude-frequency and phase-frequency characteristic of the antenna the combined data and amplitude modulated wave is fed.

5. The transmission system of claim 1 wherein a sample of the combined wave produced in (d) means is fed to a simulated data receiver and the demodulated output of the simulated receiver is fed to a difference circuit is where it is subtracted from the data input signal to produce a negative feedback term and, accordingly, reduce distortion in the data signal.

6. A transmission system for transmitting amplitude modulated waves, suitable for reception by conventional amplitude modulation broadcast receivers, simultaneously with the transmission of data signals, comprising:

(a) means for generating an amplitude modulated wave fed by a source of program material and a carrier wave source, (b) data modulation means fed by a source of data said data modulator producing a wave in the audio range, (c) means for measuring the level of the program material modulation, (d) means for controlling the data transmission speed as a function of the program level, (e) a quadrature modulator fed by the carrier wave source and by the data modulation means to produce a pair of quadrature modulation sidebands above and below the carrier frequency (f) means for controlling the level of the quadrature modulation sidebands as a function of the program level as measured in (c), (g) means for linearly combining the above produced amplitude modulated wave and the data modulation wave, and, (h) means for increasing the power level of the wave produced by (g) without introducing substantial additional spectrum products.

7. The transmission system of claim 6 wherein the (a) means is a monophonic generator fed by a monophonic source of program material.

8. The transmission system of claim 6 wherein the (a) means is a stereophonic generator fed by a stereo source of program material.

9. Equipment for simultaneously transmitting a signal suitable for reception of broadcast programs by conventional AM receivers and a signal suitable for the reception of data comprising:

(a) means for producing an amplitude modulated wave said means fed by a source of broadcast signals and a source of a carrier wave, (b) means for generating a pair of sidebands one sideband above the carrier of said amplitude modulated and the other sideband below the carrier the phasor resultant of the pair of sidebands essentially in quadrature with the carrier and said sidebands modulated from a source of data, (c) means for linearly combining the output of means (a) and (b), and, (d) Envelope Elimination and Restoration type means fed by the (c) means to be used to produce an angular modulation wave and an envelope function wave suitable for adapting a conventional AM transmitter so as to produce a combined program/-data signal.

10. An auxiliary information plus program AM transmission system comprising:

(a) means for generating a conventional monophonic or stereophonic amplitude modulated wave, (b) means for feeding (a) means with program signals, (c) means for producing a second modulated wave including means for causing the modulated wave to fall at a frequency approximately equal to an adjacent channel carrier assigned frequency, (d) means for feeding the (c) means with auxiliary information, (e) means for combining the waves resulting from the action of a/b and c/d means, (f) means for radiating the combined waves,

11. An auxiliary information plus program AM transmission system comprising:

(a) means for generating a conventional monophonic or stereophonic amplitude modulated wave, (b) means for feeding (a) means with program signals, (c) means for producing a second modulated wave, including means for causing this second modulated wave to have two components at carrier frequencies approximately equal to a first upper adjacent channel assigned frequency and a first lower adjacent channel assigned frequency, (d) means for feeding the (c) means with auxiliary information, (e) means for combining the waves resulting from the action of a/b and c/d means.

(f) means for radiating the combined waves.

12. The transmission system of claim 11 wherein the auxiliary information is in the form of a data signal and wherein the second modulated wave is a phase shift keyed wave.

13. An auxiliary information plus program AM transmission system comprising:

(a) means for generating a conventional monophonic or stereophonic amplitude modulated wave, (b) means for feeding (a) means with program signals, (c) means for producing a second modulated wave including means for causing the second modulated wave to have two components at carrier frequencies approximately equal to the carrier frequency of the emitted carrier frequency of the first modulated wave produced in (a) means $\pm 10$ kHz, (d) means for feeding the (c) means with auxiliary information, (e) means for combining the waves resulting from the action of a/b and c/d means, (f) means for radiating the combined waves,

14. The transmission system of claim 13 wherein the power amplifying means of (f) is an Envelope Elimination and Restoration system.

15. An auxiliary information plus program AM transmission and auxiliary information reception system, comprising:

(a) means for generating a conventional monophonic or stereophonic amplitude modulated wave, (b) means for feeding (a) means with program signals, (c) means for producing a second modulated wave including means for causing the modulated wave to fall at a frequency approximately equal to an adjacent channel carrier assigned frequency, (d) means for feeding the (c) means with auxiliary information, (e) means for combining the waves resulting from the action of a/b and c/d means, (f) means for power amplifying the combined waves, (g) means for radiating the amplified combined waves, (h) input means for receiving the signal radiated by (g) means, (i) means for amplifying and selecting the desired signal, (j) means for demodulating the auxiliary signal so as to derive the auxiliary information, and, (k) means for feeding the auxiliary information to utilization means,

16. A receiver for receiving an auxiliary information signal from a combined program AM transmission and auxiliary information transmission system said transmission system incorporating means for generating said auxiliary information signal as a frequency substantially equal to an adjacent channel carrier assigned frequency and comprising in combination:

(a) input means for receiving said signal, (b) means for amplifying and selecting said auxilary information signal (c) means for demodulating the auxiliary signal so as to derive the auxiliary information, (d) means for feeding the auxiliary information to utilization means.

17. An auxiliary information plus program AM transmission system comprising:

(a) means for generating a conventional monophonic or stereophonic amplitude modulated wave, (b) means for feeding (a) means with program signals, (c) means for producing a second modulated wave including means for causing modulated wave to have two components at carrier frequencies approximately equal to the carrier frequency of the emitted carrier frequency of the first modulated wave produced in (a) means $\pm 9$ kHz, (d) means for feeding the (c) means with auxiliary information, (e) means for combining the waves resulting from the action of a/b and c/d means, (f) means for radiating the combined waves.

18. The apparatus of any one of claims 10, 11, 13 or 17, further comprising means for processing the combined waves, said means including means for power amplifying and frequency translating said combined waves.

* * * * *